US005720340A

United States Patent [19]

Ohara et al.

[11] Patent Number: 5,720,340

[45] Date of Patent: Feb. 24, 1998

[54] LAMINATED TYPE HEAT EXCHANGER

[75] Inventors: Toshio Ohara, Kariya; Yasukazu Aikawa, Nagoya; Yoshiharu Kajikawa, Hekinan, all of Japan

[73] Assignee: Denso Corporation, Kariya, Japan

[21] Appl. No.: 680,655

[22] Filed: Jul. 16, 1996

[30] Foreign Application Priority Data

Jul. 20, 1995 [JP] Japan ..... 7-184253

[51] Int. Cl.[6] ..... F28F 19/02

[52] U.S. Cl. ..... 165/133; 29/890.054; 228/226; 165/134.1; 165/176; 165/153

[58] Field of Search ..... 165/133, 134.1, 165/176, 153; 29/890.054; 228/183, 226

[56] References Cited

U.S. PATENT DOCUMENTS

| | | | |
|---|---|---|---|
| 4,949,543 | 8/1990 | Cottone et al. | 165/133 X |
| 5,042,574 | 8/1991 | Cottone et al. | 165/133 |
| 5,125,452 | 6/1992 | Yamauchi et al. | 165/134.1 X |
| 5,176,205 | 1/1993 | Anthony | 165/134.1 X |

FOREIGN PATENT DOCUMENTS

| | | | |
|---|---|---|---|
| 0083596 | 4/1988 | Japan | 165/133 |
| 0273792 | 11/1988 | Japan | 165/133 |
| 0142394 | 6/1989 | Japan | 165/133 |
| 0085697 | 3/1990 | Japan | 165/133 |
| 4131698 | 5/1992 | Japan . | |
| 6011295 | 1/1994 | Japan | 165/133 |

OTHER PUBLICATIONS

Journal of Nippondenso Technical Disclosure 70–148 dated Feb. 15, 1990.

*Primary Examiner*—John Rivell
*Assistant Examiner*—Christopher Atkinson
*Attorney, Agent, or Firm*—Harness, Dickey & Pierce, PLC

[57] ABSTRACT

A laminated type heat exchanger includes a plurality of refrigerant passages which are formed by pairs of core plates. Each core plate comprises an outer covering layer, a core layer, and an inner covering layer. The outer covering layer is made of a brazing material of which electric potential is more negative than the core layer while the inner covering layer is made of a brazing material of which electric potential is equal to or more positive than the core layer. The refrigerant passages are formed by brazing only the adjacent two of the inner covering layer. The outer covering layer works as a sacrificial corrosive material with respect to the inner covering layer and the core layer. Leakage of refrigerant from the brazed portions of the core plates is prevented, whereby the corrosion resistance of the laminated type heat exchanger is improved.

18 Claims, 4 Drawing Sheets

LAMINATED TYPE HEAT EXCHANGER

CROSS REFERENCE TO RELATED APPLICATION

This application is based upon and claims the benefit of priority of the prior Japanese Patent Application No. 7-184253 filed on Jul. 20, 1995, the contents of which are incorporated herein by reference.

BACKGROUND OF THE INVENTION

1. Field of the Invention

The present invention relates to a laminated type heat exchanger which is preferably used for an evaporator of an automotive air conditioning system and the like.

2. Related Arts

In conventional laminated type heat exchangers, a pair of core plates is formed so that its shape becomes symmetrical to each other when laminated. Clad layers made by cladding brazing materials on both surface of a core layer are used.

On the outer surface of the core plate, that is on the side surface of the core layer is formed an outer covering layer (brazing material) made of a material of which electric potential is more negative than that of the core layer. The outer covering layers of the pair of the core plates are abutted with and brazed to adjacent outer covering layers of another pair of core plates. Since the outer covering layer works as a sacrificial corrosive material, the core layer is effectively prevented from corroding until the outer covering layer disappears by corrosion.

At the brazed portion between the outer covering layers, the joined portion resulting in the sacrificial corrosive portion, it is more corrosive. Therefore, there occurs a problem that the joined portion is damaged, thus causing a leakage of a refrigerant therethrough.

To counter this problem, in a laminated type heat exchanger disclosed in JOURNAL OF NIPPONDENSO TECHNICAL DISCLOSURE NO. 70-148 (publication date: Feb. 15, 1990) or Japanese Patent Laid-open NO. 4-131698, as shown in FIG. 5, to avoid brazing between outer covering layers 12, 22 of core plates 10, 20 which are formed symmetrically, joined portions **14*b*, 24*b* are formed as illustrated so that inner covering layers (brazing material) 11, 21 of the core plate 10, 20** are brazed each other.

In this case, the joined portions **14*b*, 24*b* of the core plates 10, 20 are prevented from corroding, whereby the structure does not result in the leakage of refrigerant. However, when the electric potential of the inner covering layers 11, 21 is more negative than that of the core layers 13, 23, the inner covering layers 11, 21 work as the sacrificial corrosive material with respect to the core layers 13, 23 as the outer covering layers 12, 22** do. Consequently, there is a likelihood of the leakage of refrigerant by the corrosion of the inner covering layers at the brazed portion.

SUMMARY OF THE INVENTION

The present invention, having been accomplished in view of the above mentioned problems, has an object to provide a laminated type heat exchanger which has good corrosion resistance without a corrosion damage at a joined portion between core plates.

According to the present invention, an inner covering layer is made of a material of which electrical potential is more positive than a core layer, so that there occurs less likelihood that the front end joined surface becomes more susceptible to corrosion and leakage of refrigerant is minimized. Further, the corrosion resistance of the inner covering layer is improved more than that of the core layer.

An outer covering layer does not form a front end joined surface. The electric potential of the outer covering layer can be made more negative compared to the core layer and the inner covering layer. Therefore, the outer covering layer works as the sacrificial corrosive material with respect to the core layer and the inner covering layer to improve the corrosion resistances of the core layer and the inner covering layer greatly, and the corrosion resistance of the laminated type heat exchanger can be improved greatly.

Preferably, a middle layer is formed between the core layer and the outer covering layer and the relation of electrical potentials among the outer covering layer, the middle layer, the core layer, and the inner covering layer is kept as follows: the outer covering layer<the middle layer <the core layer<the inner covering layer. The brazing of the front end joined surfaces is made between the inner covering layers. Therefore, the outer covering layer works as the sacrificial corrosive material with respect to the middle layer, the core layer, and the inner covering layer. Even if the outer covering layer is corroded completely, the middle layer works as the sacrificial corrosive material next with respect to the core layer and the inner covering layer. Consequently, the corrosion resistances of the core layer and the inner covering layer can be improved more.

BRIEF DESCRIPTION OF THE DRAWINGS

The present invention will become more fully understood from the detailed description given hereinbelow and the accompanying drawings which are given by way of illustration only and are not intended to limit the present invention, and wherein.

DETAILED DESCRIPTION OF THE PRESENTLY PREFERRED EXEMPLARY EMBODIMENTS

Embodiments according to the present invention will be described hereinunder with reference to preferred embodiments, wherein the present invention is applied for a refrigerant evaporator of a vehicular air conditioning system.

Figure 1A:
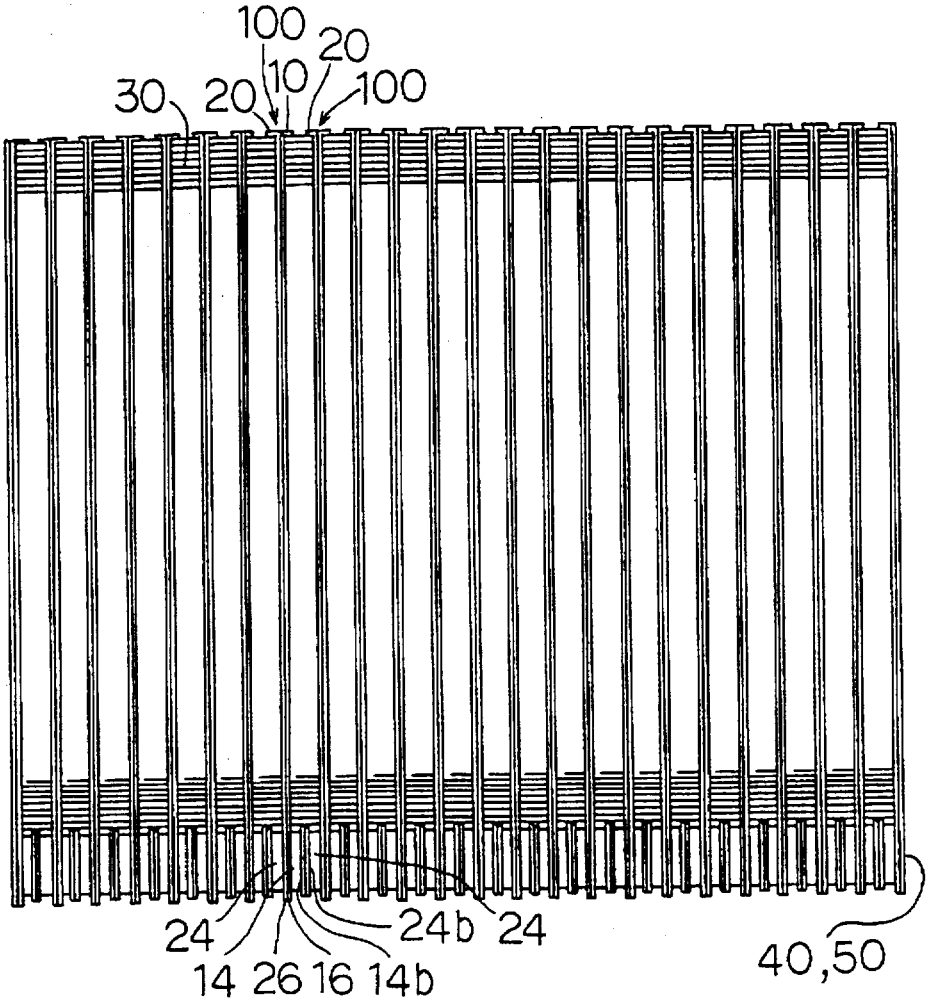
FIG. 1A is a front view showing a refrigerant evaporator according to a first embodiment of the present invention.
Figure 1B:
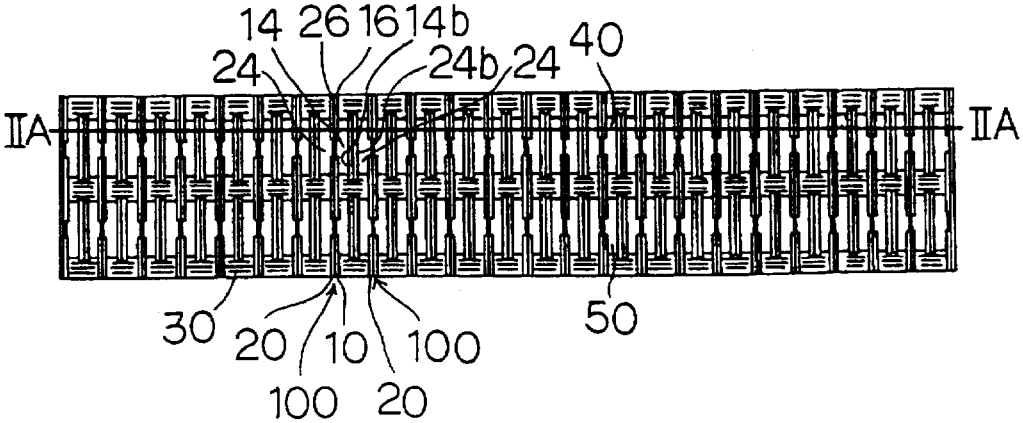
FIG. 1B is a bottom view showing the refrigerant evaporator shown in FIG. 1A.

In FIGS. 1A and 1B, reference numeral 100 indicates tubes forming refrigerant passages 101 (see FIG. 2A) which are in the U-shape and make the flow of a refrigerant do U-turn in the upper end of FIG. 1A. Numeral 30 indicates corrugated fins which are disposed between the outer surface sides of the tubes 100 and joined thereto for increasing the heat exchanging area.

Numeral 40 is an inlet tank which is disposed at the lower end in the front side in FIG. 1A to receive incoming refrigerant therein. The inlet tank 40 communicates with all inlets of the plural tubes 100 and the refrigerant is distributed into the plural tubes 100 from the inlet tank 40 at the same time. Numeral 50 is an outlet tank which is disposed at the lower end in the back side in FIG. 1A and which communicates with the outlets of the tubes 100. The refrigerant which has passed the tubes 100 flow into the outlet tank 50. That is, the refrigerant passages 101 make the refrigerant, which has entered from the inlet tank 40 (lower end in the front side in FIG. 1A), do U-turn at the upper end in FIG. 1A and flow into the outlet tank 50 (lower end in the back side in FIG. 1A).

Figure 2A:
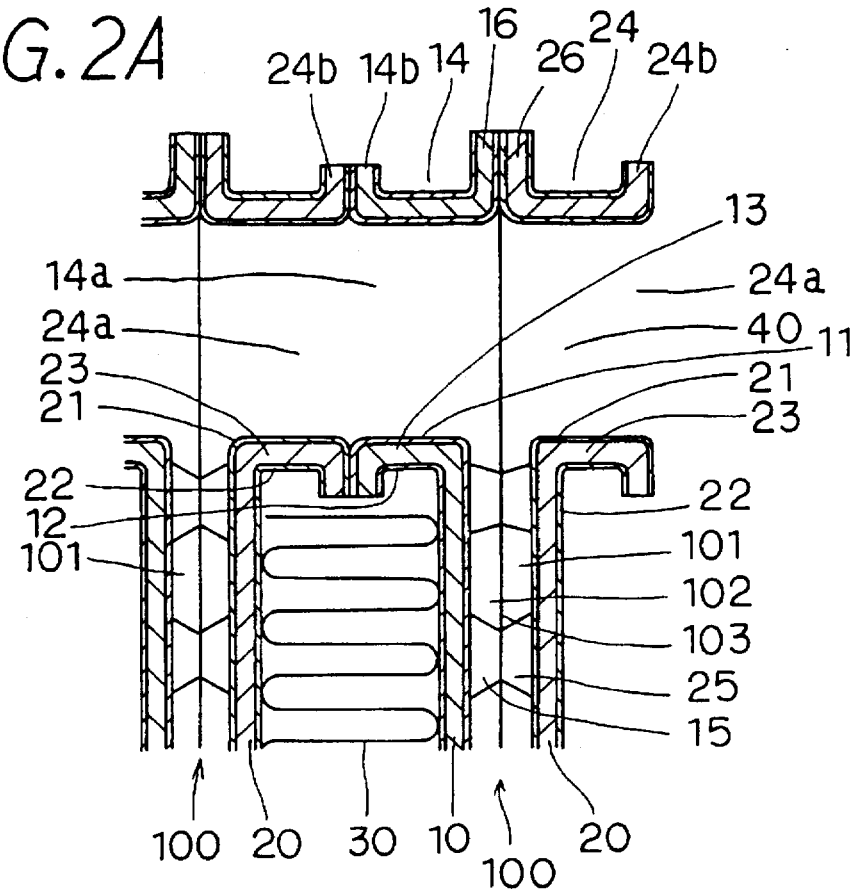
FIG. 2A is a fragmentary sectional view of the refrigerant evaporator, taken along the ΠA—ΠA line in FIG. 1B.
Figure 2B:
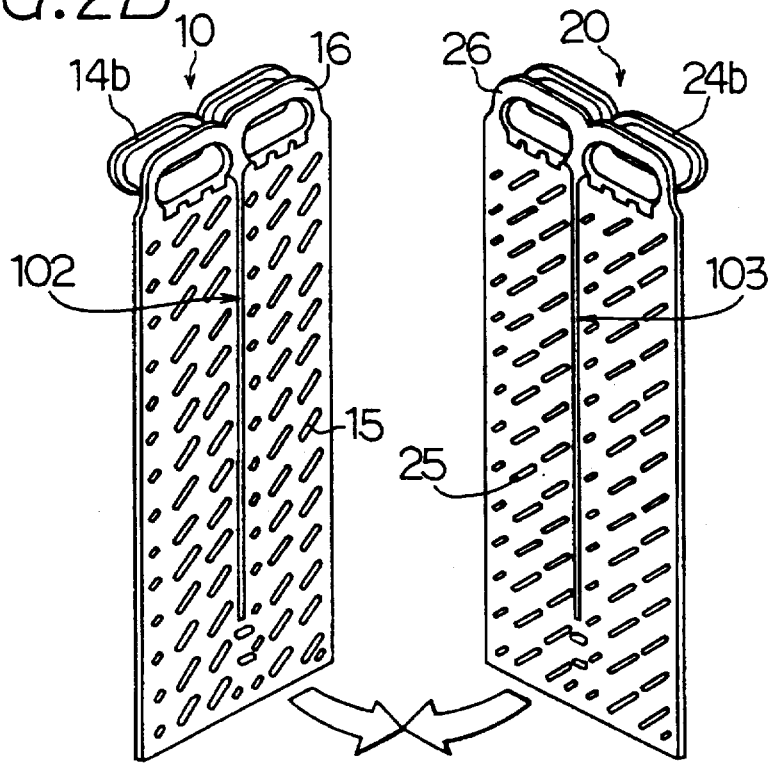
FIG. 2B is a schematic view showing a whole form of a pair of core plates.
Figure 3:
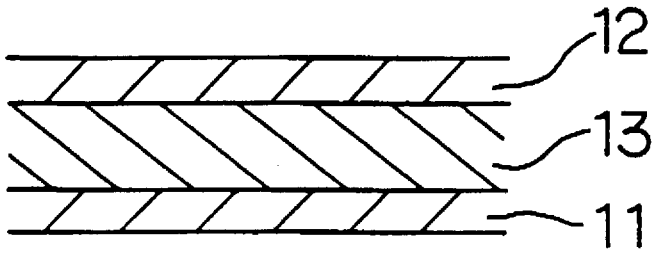
FIG. 3 is a sectional view of clad layers of a core plate according to the first embodiment.

As shown in FIG. 2A, a pair of core plates 10, 20 constitute the tube 100, and inlet and outlet tanks 40, 50. The core plates 10, 20 are formed into a predetermined shape as shown in FIG. 2B (a concave shape in which the portion serving as the refrigerant passage 101 is concave) and made of aluminum having good thermal conductivity, corrosion resistance, and machinability and the like. The pair of the core plates 10, 20 is joined as a couple, whereby the above mentioned U-turn shaped refrigerant passage 101 is formed.

Next, materials of clad layers which are used for the core plates 10, 20 and are basically made of aluminum will be described.

An outer covering layer 12 on the outer surface of the core plate 10 is made of A4104 and 2–5 wt % Zn material and of which electric potential is –710 mV. A core layer 13 of the clad layers is made of A3003 material and of which electric potential is –660 mV. An inner covering layer 11 on the inner surface of the core plate 10 is made of A4104 and 0.5 wt % Cu material and of which electric potential is –660 through –640 mV. Here, A denotes an aluminum alloy.

In this case, the difference in electric potentials between the core layer 13 and the inner covering layer 11 is 0 through 20 mV, and the difference in electric potentials between the core layer 13 and the outer covering layer 12 is 50 mV. Concerning the outer covering layer 12, the minimum difference in electric potentials between the outer covering layer 12 and the core layer 13 required to maintain the corrosion resistance of the core layer 13 is about 20 mV. When the difference is over 50 mV, the outer covering layer 12 corrodes quickly and disappears, whereby it can not work as the sacrificial corrosive material for a long time. Therefore, the relation of electrical potentials is set as mentioned above.

Concerning the inner covering layer 11, since it should not work as the sacrificial corrosive material with respect to the core layer 13, it is acceptable for the electric potential of the inner covering layer 11 not to be less than that of the core layer 13. When the difference in electric potentials between the inner covering layer 11 and the core layer 13 is about 0 mV, the inner covering layer 11 has almost the same corrosion resistance as the core layer 13. When the difference of electric potentials therebetween is about 20 mV, the corrosion resistance of the inner covering layer 11 is improved more than that of the core layer 13.

The plate thickness of the clad layers is about 0.4 through 0.6 mm. The clad layers are pressed into the predetermined shape to form the core plate 10. All the core plates which are applied for the laminated type heat exchanger of the present invention are comprised of the above mentioned clad layers.

Partition portions 102, 103 centrally formed on the core plates 10, 20 are provided to project from the lower side of the tank 40 to the lower side of the core plates 10, 20 (see FIG. 2B). The partition portions 102, 103 are joined while the pair of the core plates 10, 20 are joined.

Ribs 15, 25 are provided to disturb the flow of the refrigerant in the refrigerant passage 101 to improve the heat conductivity of the refrigerant.

The pair of core plates 10, 20 having the partition portions 102, 103 and outer circumferential parts 16, 26 form the U-turn shaped refrigerant passage 101 extending from the inlet tank 40 to the outlet tank 50. In the refrigerant passage 101, the refrigerant is repeatedly changed its flow direction by the ribs 15, 25.

Bowl-shaped protruding portions 14, 24 are formed on the end of the core plates 10, 20 to form the inlet tank 40. The bowl-shaped protruding portions 14, 24 have central opening portions **14*a*, 24*a* to communicate each other. In the bowl-shaped protruding portions 14, 24 forming the inlet tank 40, the front end joined surfaces at the side of the opening portions 14*a*, 24*a* for communication are formed with flange portions 14*b*, 24*b* protruding outward more than the outer surface of each tank 40, 50. Therefore, on the front end joined surfaces at the side of the opening portions 14*a*, 24*a* are disposed the inner covering layers 11, 21**.

When two tubes 100 are disposed adjacently as shown in FIG. 2A to assemble the laminated type heat exchanger, the inner covering layers 11, 21 of the flange portions **14*b*, 24*b* serve as the joined surfaces. The inner covering layer 11 of the front end joined surface at the side of the opening 14*a* abuts the inner covering layer 21 of the front end joined surface at the side of the opening portion 24*a* and is brazed so that joined portions of the core plates 10, 20 are made by the inner covering layers 11, 21. FIG. 2A shows only the inlet tank 40 but the structure at the side of outlet tank 50** which is not shown is similar.

As mentioned above, all the junctions of the partition portions 102, 103 of the core plates 10, 20, the ribs 15, 25, the outer circumferential portions 16, 26, and the flange portions **14*b*, 24*b* of the core plates 10, 20 are made by joining of the inner covering layers 11, 21. Since the inner covering layers 11, 21 are made of the material of which electric potential is positive compared with that of the core layers 13, 23, there is the least possibility that the front end joined surfaces which are formed by brazing the inner covering layers 11, 21 are corroded, whereby the problem of the leakage of the refrigerant is solved. The corrosion resistance of the inner covering layers 11, 21 is improved than that of the core layers 13, 23, whereby the corrosion resistance of the front end joined surface is improved. Further, the outer covering layers 12, 22 are not joined to each other. Therefore, the electric potential of the outer covering layers 12, 22 can be made more negative within the above mentioned range compared with the core layers 13, 23. As a result, the outer covering layers 12, 22 can work as the sacrificial corrosive material with respect to the core layers 13, 23 and the inner covering layers 11, 21, whereby the corrosion resistances of the core layers 13, 23 and the inner covering layers 11, 21** can be improved greatly.

The assembly of the refrigerant evaporator is made by brazing. That is, after assembled provisionally by some fixtures in the state shown in FIGS. 1A and 1B, the core plates 10, 20 and the corrugated fins 30 are brazed integrally in the vacuum furnace.

As shown in FIG. 1A, the refrigerant evaporator is disposed in a cooling unit of the vehicular air conditioning system in such a state as the inlet and outlet tanks 40, 50 lie below and the U-turn side of the tube 100 lies above.

Next, a second embodiment will be described below referring to FIG. 4.

Figure 4:
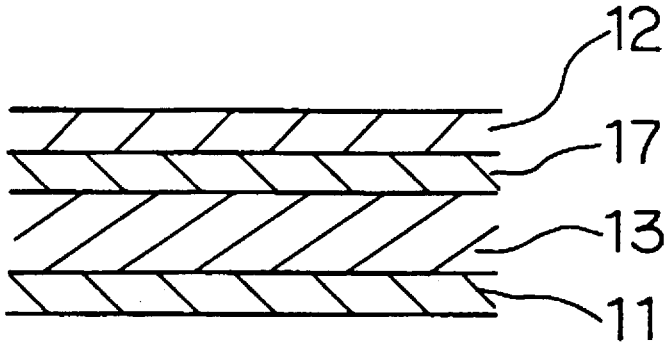
FIG. 4 is a sectional view of clad layers of a core plate according to a second embodiment.
Figure 5:
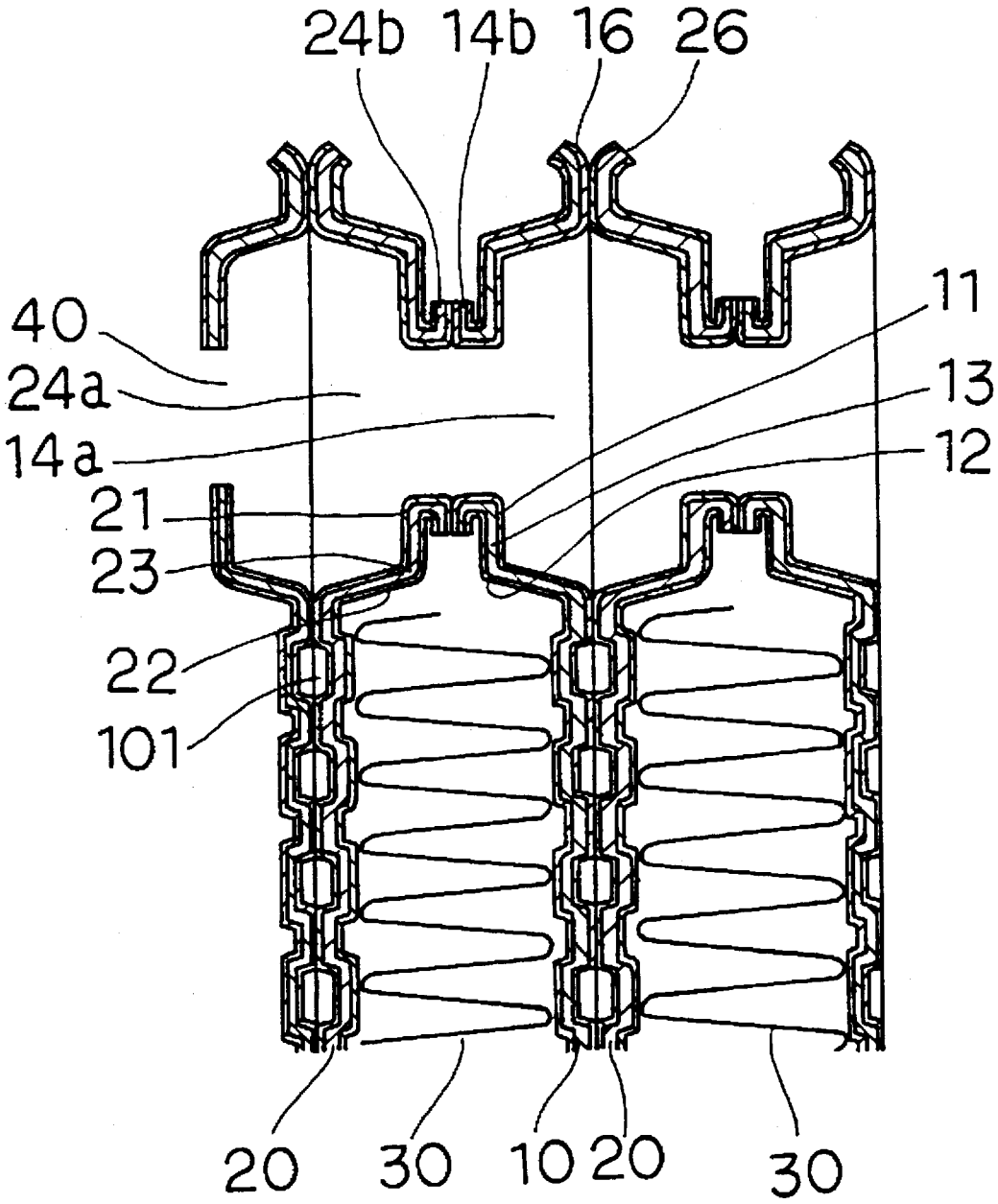
FIG. 5 PRIOR ART
FIG. 5 is an enlarged fragmentary sectional view showing main parts of a conventional laminated type heat exchanger.

As shown in FIG. 4, the clad layers for the core plate 10 of the first embodiment has additionally a middle layer 17, which is made of A1050 material and has electrical potential of −690 mV, between the core layer 13 and the outer covering layer 12. That is, the relation of the electric potentials between the outer covering layer 12, the middle layer 17, the core layer 13, and the inner covering layer 11 is set as follows: the outer covering layer 12<the middle layer 17<the core layer 13<the inner covering layer 11. Further, the front end joined surface is brazed by the inner covering layer 11. Therefore, the outer covering layer 12 works as the sacrificial corrosive material with respect to the middle layer 17, core layer 13, and the inner covering layer 11.

Even if the outer covering layer 12 is corroded excessively, the middle layer 17 works as another sacrificial corrosive material with respect to the core layer 13 and the inner covering layer 11. Therefore, the corrosion resistances of the core layer 13 and the inner covering layer 11 can be improved more. Here, all core plates of the laminated type heat exchanger in the second embodiment are also made of the above mentioned clad layers.

Although the clad layers comprise the outer covering layer 12, the core layer 13, and the inner covering layer 11 with or without the middle layer 17 in the embodiments, it is acceptable for the outer covering layer 12, the middle layer 17, the core layer 13, and the inner covering layer 11 to be made by different materials, as long as the above mentioned relation in the difference of the electric potentials, good thermal conductivity, corrosion resistance, and machinability and the like are maintained.

For example, when the core layer 13 is added with Ti, its electrode potential does not change, thus the same effect as the above mentioned embodiments can be attained. By the addition of Ti, the corrosion does not advance in the direction of the plate thickness, but advances in the direction of the surface, whereby it is prevented that the core plate 10 is penetrated by holes caused by the corrosion.

Further, although in the above mentioned embodiments the inlet and outlet tanks 40, 50 are disposed lower, the inlet and outlet tanks 40, 50 may lie above with the U-turn side of the tube 100 lying lower when the refrigerant evaporator is used for the cooling unit of the vehicular air conditioning system.

Although in the above mentioned embodiments the refrigerant passage 101 is formed in the U-shape, the inlet tank 40 may be formed on one end of the core plate 10 and the outlet tank 50 may be formed on the other end of the core plate 10 so that the refrigerant flows only in one direction from the one end to the other end.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined in the appended claims.

What is claimed is:

1. A laminated type heat exchanger comprising:

a pair of core plates joined to form a fluid passage therebetween and laminated in plural numbers to form a passage unit;

a tank portion having a tube-like shape and integrally formed with each of said core plates at a longitudinal end of said core plates to form a tank in fluid communication with said passage unit; and corrugated fins disposed between adjacent pairs of core plates, wherein each of said core plates comprises laminated layers of a core layer, an outer covering layer disposed on an outer side of said tank portion and said fluid passage and made of a material of which electrical potential is more negative than said core layer, and an inner covering layer disposed on an inner side of said tank portion and said fluid passage and made of a material of which electrical potential is more positive than said core layer;

said pair of core plates being joined only with said inner covering layers thereof; and said tank portion having a flange portion at an end thereof, which is bent to protrude outward from an outer surface of said tank portion and to expose said inner covering layer to be joined with said inner covering layer of another tank portion of adjacent pair of core plates.

2. A laminated type heat exchanger according to claim 1, wherein a middle layer of which electrical potential is more negative than said core layer and more positive than said outer covering layer is formed between said core layer and said outer covering layer.

3. A laminated type heat exchanger according to claim 1, wherein said outer covering layer and said inner covering layer are made of brazing materials.

4. A laminated type heat exchanger according to claim 1, wherein said core plates are made of aluminum alloys.

5. A laminated type heat exchanger according to claim 1, wherein said laminated type heat exchanger is used for an evaporator of an air conditioning system.

6. A laminated type heat exchanger according to claim 1, wherein said outer covering layer is made of A4104 and 2–5 wt % Zn, said core layer is made of A3003, and said inner covering layer is made of A4104 and 0.5 wt % Cu.

7. A laminated type heat exchanger according to claim 1, wherein said core layer is added with titanium.

8. A laminated type heat exchanger comprising:

a pair of core plates joined to form a fluid passage therebetween and laminated in plural numbers to form a passage unit;

a tank portion having a tube-like shape, integrally formed with each of said core plates at a longitudinal end of said core plates to protrude approximately in a perpendicular direction relative to said core plates and to have a flange portion at an end opposite to a core plate side end thereof, said tank portion forming a tank in fluid communication with said passage unit; and corrugated fins disposed between adjacent pairs of core plates to face said flange portion of said tank portion, wherein each of said core plates comprises laminated layers of a core layer, an outer covering layer disposed on an outer side of said tank portion and said fluid passage, and an inner covering layer disposed on an inner side of said tank portion and said fluid passage and made of a material of which electrical potential is more positive than said core layer; and said flange portion of said tank portion protrudes outward from an outer surface of said tank portion and exposes said inner covering layer thereon to be joined only with said inner covering layer of another tank portion of adjacent pair of core plates.

9. A laminated type heat exchanger according to claim 8, wherein electric potential of said inner covering layer is almost equal to electric potential of said core layer.

10. A laminated type heat exchanger according to claim 1, wherein a difference in electrical potentials between said inner covering layer and said core layer is about 0–20 mV.

11. A laminated type heat exchanger according to claim 1, wherein said corrugated fins are fixed to said outer covering layer of said core plates.

12. A core plate for a laminated type heat exchanger in which fluid flows for exchanging heat with an outside atmosphere, said core plate comprising:

a core member having a passage portion for forming a fluid passage with another core plate, and a tank portion formed at a longitudinal end of said passage portion to protrude approximately perpendicularly with respect to the passage portion, said tank portion having a tube-like shape with flange portions at both ends thereof;

an outer covering layer having more negative electrical potential than said core member, said outer covering layer formed on a first surface of said core member to be entirely exposed to said outside atmosphere; and an inner covering layer having more positive electrical potential than said core member, said inner covering layer formed on a second surface of said core member to be isolated from said outside atmosphere, said second surface of said core member including end surfaces of said flange portions of said tank portion, said end surfaces of said flange portions which are to be joined to other core plates, respectively, to form said laminated type heat exchanger.

13. A core plate according to claim 12, further comprising a middle layer formed between said core member and said outer covering layer, electrical potential of which is more negative than said core member and more positive than said outer covering layer.

14. A core plate according to claim 12, wherein said outer covering layer and said inner covering layer are made of brazing materials.

15. A core plate according to claim 12, wherein said core plates are made of aluminum alloys.

16. A core plate according to claim 12, wherein said laminated type heat exchanger is used for an evaporator of an air conditioning system.

17. A core plate according to claim 12, wherein said outer covering layer is made of A4104 and 2–5 wt % Zn, said core member is made of A3003, and said inner layer is made of A4104 and 0.5 wt % Cu.

18. A core plate according to claim 12, wherein titanium is added to said core member.

* * * * *